US006881527B2

(12) United States Patent
Moribe et al.

(10) Patent No.: US 6,881,527 B2
(45) Date of Patent: Apr. 19, 2005

(54) TONER, AND PROCESS CARTRIDGE

(75) Inventors: Shuhei Moribe, Shizuoka (JP); Hirohide Tanikawa, Shizuoka (JP); Hiroshi Yusa, Tokyo (JP); Takashige Kasuya, Shizuoka (JP); Yoshihiro Ogawa, Shizuoka (JP); Hideto Iida, Shizuoka (JP); Katsuhisa Yamazaki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 104 days.

(21) Appl. No.: 10/391,563

(22) Filed: Mar. 20, 2003

(65) Prior Publication Data

US 2004/0005509 A1 Jan. 8, 2004

(30) Foreign Application Priority Data

Mar. 26, 2002 (JP) ..... 2002-085471
Mar. 26, 2002 (JP) ..... 2002-085712

(51) Int. Cl.[7] ..... G03G 9/087
(52) U.S. Cl. ..... 430/109.4; 430/111.4
(58) Field of Search ..... 430/109.4, 111.4

(56) References Cited

U.S. PATENT DOCUMENTS

| | | | | |
|---|---|---|---|---|
| 5,266,432 A | | 11/1993 | Hayashi et al. | 430/109 |
| 5,660,963 A | * | 8/1997 | Doujo et al. | 430/109.4 |
| 5,747,210 A | * | 5/1998 | Emoto et al. | 430/109.4 |
| 5,976,752 A | | 11/1999 | Matsunaga et al. | 430/110 |

FOREIGN PATENT DOCUMENTS

| | | |
|---|---|---|
| EP | 0 460 631 A2 | 12/1991 |
| JP | 63-60904 | 11/1988 |
| JP | 3-197971 | 8/1991 |
| JP | 3-269542 | 12/1991 |
| JP | 4-70765 | 5/1992 |
| JP | 8-297378 | 11/1996 |
| JP | 00/29246 | 1/2000 |
| JP | 2002-55485 | 2/2002 |

* cited by examiner

*Primary Examiner*—Christopher Rodee
(74) *Attorney, Agent, or Firm*—Fitzpatrick, Cella, Harper & Scinto

(57) ABSTRACT

In a toner having a polyester resin as a binder resin component, and a colorant, the toner contains (a) in the binder resin component, from 20.0% by weight to 65.0% by weight of a tetrahydrofuran-insoluble matter A1 in 6-hour extraction and from 35.0% by weight to 80.0% by weight of a tetrahydrofuran-soluble matter A2 in 6-hour extraction, (b) in the binder resin component, from 10.0% by weight to 30.0% by weight of a tetrahydrofuran-insoluble matter B1 in 16-hour extraction and from 70.0% by weight to 90.0% by weight of a tetrahydrofuran-soluble matter B2 in 16-hour extraction, and (c) in the binder resin component, from 0.5% by weight to 3.0% by weight of an orthodichloro-benzene-insoluble matter C1 in 6-hour extraction at 185° C. and from 97.0% by weight to 99.5% by weight of an orthodichlorobenzene-soluble matter C2 in 6-hour extraction at 185° C. The proportion of C1 to B1, C1/B1, is from 0.06 to 0.15, and the A1, B1 and C1 satisfy the following expression (1):

$$A1>B1>C1. \qquad \text{Expression (1)}$$

A process cartridge makes use of this toner.

6 Claims, 2 Drawing Sheets

TONER, AND PROCESS CARTRIDGE

BACKGROUND OF THE INVENTION

1. Field of the Invention

This invention relates to a toner used in electrophotography, electrostatic recording, toner jet recording and the like, and a process cartridge making use of the toner.

2. Related Background Art

Conventionally, as resins for toners, vinyl copolymers (such as styrene resins) and polyester resins are chiefly used. The vinyl copolymers such as styrene resins show superior pulverizability when toners are produced, and have superior high-temperature anti-offset properties because they can be made to have high molecular weight with ease. However, in an attempt to lower molecular weight in order to improve low-temperature fixing performance, anti-blocking properties and developing performance may come poor. As for the polyester resins, though having high glass transition temperatures, they can readily provide resins having low softening points, and, when melted by heating, have so good wettability to fixing sheets such as paper that the fixing can sufficiently be performed at lower temperatures.

On the other hand, however, the polyester resins simultaneously have a disadvantage that they tend to cause a phenomenon of high-temperature offset. For the purpose of providing resistance to such offset, a large number of proposals have been made, e.g., on making molecular weight distribution double-peak, on a polyester resin containing chloroform-insoluble matter as disclosed in Japanese Patent Publication No. 63-60904, and on a polyester resin having THF-insoluble matter as disclosed in Japanese Patent Application Laid-open Nos. 3-269542 and No. 4-70765.

Using as binders the polyester resins having such insoluble matter may make it possible to obtain toners having superior anti-offset properties, but may cause the polyester resins, which have a problem in improving pulverizability because of their original toughness, to have much poorer pulverizability. This may lower productivity greatly in producing small-particle-diameter toners which are necessary for achieving higher image quality of copied images. Also, because of their relatively high softening points, it can not necessarily be said to promise good low-temperature fixing performance. Further, as disclosed in Japanese Patent Application Laid-open Nos. 3-197971 and 8-297378, the molecular weight of insoluble matter is specified in addition to the molecular weight of soluble matter, but, under the existing circumstances, it is sought to make further improvement from the viewpoint of high-temperature anti-offset properties.

Furthermore, as disclosed in Japanese Patent Application Laid-open No. 2000-029246, the dielectric dissipation factor (tan δ) of polyester resin is specified in order to improve low-temperature fixing performance and high-temperature anti-offset properties. However, the dielectric dissipation factor of toner is not measured, and hence it can not be said to have sufficiently controlled the performance of toner. Any annealing is also not carried out when the polyester resin is taken out of a reaction chamber, and hence, in order to achieve the desired quantity of THF-insoluble matter, it is necessary to set conditions under which the reaction may more proceed or to use a cross-linking agent in a larger quantity. However, the THF-insoluble matter formed under such conditions tends to come hard, so that not only the low-temperature fixing performance may not sufficiently be satisfied, but also the pulverizability in producing the toner may come poor, resulting in a very low productivity of the toner.

Thus, although there are disclosures as to the quantity of insoluble matter and the molecular weight distribution of soluble matter, there is no disclosure which refers to any strict control of insoluble matter in respect to different solvents. Also, under the existing conditions, those which can highly satisfy all the low-temperature fixing performance, high-temperature anti-offset properties and toner productivity have not yet been available.

SUMMARY OF THE INVENTION

An object of the present invention is to solve the above problems, and to propose a toner which can be produced in a superior pulverizability (pulverizability in toner production), and also has a broad fixable temperature region in virtue of good low-temperature fixing performance, anti-offset properties and releasability and has uniform charging performance over a long period of time, and a process cartridge making use of the toner.

The present invention provides a toner which contains at least a polyester resin as a binder resin component, and a colorant, wherein;

the toner contains:

(a) in the binder resin component, from 20.0% by weight to 65.0% by weight of a THF(tetrahydrofuran)-insoluble matter A1 in 6-hour extraction and from 35.0% by weight to 80.0% by weight of a THF-soluble matter A2 in 6-hour extraction;

(b) in the binder resin component, from 10.0% by weight to 30.0% by weight of a THF-insoluble matter B1 in 16-hour extraction and from 70.0% by weight to 90.0% by weight of a THF-soluble matter B2 in 16-hour extraction; and (c) in the binder resin component, from 0.5% by weight to 3% by weight of an ODCB(orthodichlorobenzene)-insoluble matter C1 in 6-hour extraction at 185° C. and from 97.0% by weight to 99.5% by weight of an ODCB-soluble matter C2 in 6-hour extraction at 185° C.;

(d) the proportion of C1 to B1, C1/B1, being from 0.06 to 0.15, and the A1, B1 and C1 satisfying the following expression (1):

$$A1>B1>C1. \qquad \text{Expression (1)}$$

The present invention is also a process cartridge which has an electrostatic latent image bearing member and a developing means for developing by the use of a toner an electrostatic latent image formed on the electrostatic latent image bearing member, and is detachably mountable to the body of an image-forming apparatus;

the toner containing at least a polyester resin as a binder resin component, and a colorant, wherein;

the toner contains:

(a) in the binder resin component, from 20.0% by weight to 65.0% by weight of a THF(tetrahydrofuran)-insoluble matter A1 in 6-hour extraction and from 35.0% by weight to 80.0% by weight of a THF-soluble matter A2 in 6-hour extraction;

(b) in the binder resin component, from 10.0% by weight to 30.0% by weight of a THF-insoluble matter B1 in 16-hour extraction and from 70.0% by weight to 90.0% by weight of a THF-soluble matter B2 in 16-hour extraction; and (c) in the binder resin component, from 0.5% by weight to 3% by weight of an ODCB(orthodichlorobenzene)-insoluble matter C1 in 6-hour extraction at 185° C. and from 97.0% by weight to 99.5% by weight of an ODCB-soluble matter C2 in 6-hour extraction at 185° C.;

(d) the proportion of C1 to B1, C1/B1, being from 0.06 to 0.15, and the A1, B1 and C1 satisfying the following expression (1):

$$A1>B1>C1. \qquad \text{Expression (1)}$$

DESCRIPTION OF THE PREFERRED EMBODIMENTS

Figure 1:
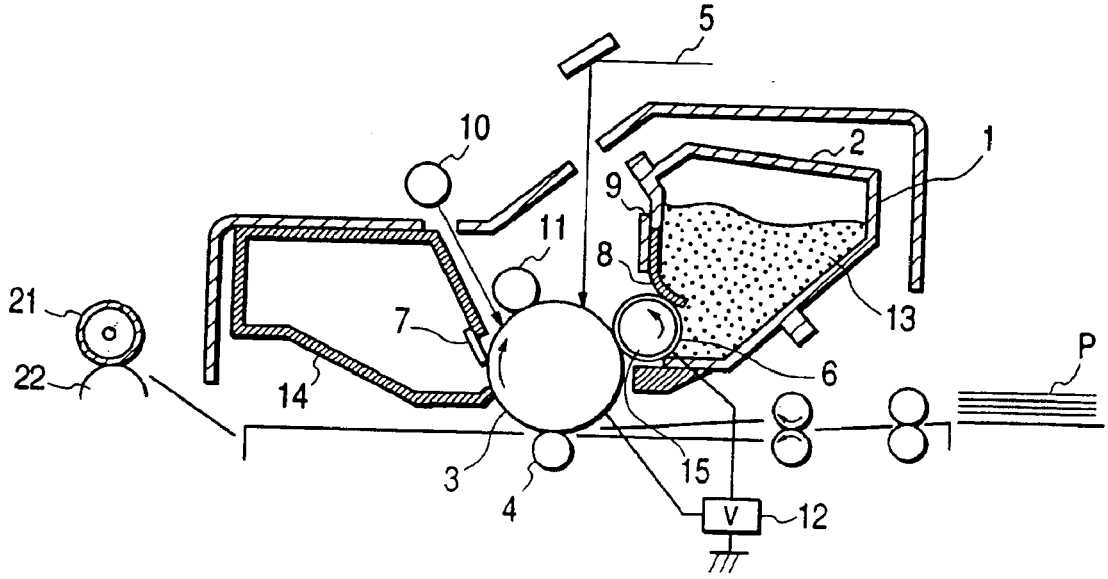
FIG. 1 is a schematic view showing an example of an image-forming apparatus fit to form images by the use of a magnetic toner according to the present invention.

The present inventors have pushed studies forward on component materials used in toners, and have discovered that the quantities of insoluble matter and soluble matter when extracted with a specific solvent which are contained in a binder resin component in the toner are greatly concerned not only in the low-temperature fixing performance and high-temperature anti-offset properties but also in the pulverizability in producing the toner. The present inventors have further discovered that the controlling of a difference by extraction time between insoluble-matter quantity when extracted with a specific solvent and insoluble-matter quantity when extracted with a solvent having a different boiling point can bring the above effect. They have still further discovered that both the anti-offset properties and the toner pulverization performance are highly achievable by specifying the proportion of insoluble matter C1 to insoluble matter B1, C1/B1.

The toner of the present invention is characterized by containing in the binder resin component from 20.0 to 65.0% by weight, and preferably from 25.0 to 60.0% by weight, of a THF-insoluble matter A1 in 6-hour extraction. If this THF-insoluble matter is less than 20.0% by weight, the toner may have a low anti-offset properties at fine-line areas. If on the other hand it is more than 65.0% by weight, the toner may have an inferior low-temperature fixing performance. Meanwhile, a THF-soluble matter A2 in 6-hour extraction in the binder resin component is a component which is effective for low-temperature fixing. For this reason, the toner is characterized by also containing from 35.0 to 80.0% by weight, and preferably from 40.0 to 75.0% by weight, of the THF-soluble matter A2 in 6-hour extraction. If this THF-soluble matter is less than 35.0% by weight, the toner may have a greatly low low-temperature fixing performance. If on the other hand it is more than 80.0% by weight, the toner may have very low anti-offset properties.

The toner of the present invention also contains in the binder resin component from 10.0 to 30.0% by weight, preferably from 10.0 to 25.0% by weight, of a THF-insoluble matter B1 in 16-hour extraction. This THF-insoluble matter B1 is an essential component for especially improving the anti-offset properties. Hence, if it is less than 10.0% by weight, the resin has less elasticity to have a low releasability, resulting in poor anti-offset properties at solid-black areas. If on the other hand it is more than 30.0% by weight, an inferior pulverizability in toner production may result. A THF-soluble matter B2 in 16-hour extraction in the binder resin component is also a component which is effective for low-temperature fixing, like the A2. For this reason, the toner is characterized by also containing from 70.0 to 90.0% by weight, and preferably from 75.0 to 90.0% by weight, of the THF-soluble matter B2 in 16-hour extraction. If this THF-soluble matter is less than 70.0% by weight, the toner may have a low fixing performance at fine-line areas. If on the other hand it is more than 90.0% by weight, the toner may have very low anti-offset properties.

The toner of the present invention also contains in the binder resin component from 0.5% by weight to 3% by weight of an ODCB(orthodichlorobenzene)-insoluble matter C1 in 16-hour extraction at 185° C. and from 97.0% by weight to 99.5% by weight of an ODCB-soluble matter C2 in 16-hour extraction at 185° C.

In addition, the THF-insoluble matter A1 in 6-hour extraction and the THF-insoluble matter B1 in 16-hour extraction may be in a difference (insoluble-matter quantity A1−insoluble-matter quantity B1) of from 10.0 to 55.0% by weight, and preferably from 15.0 to 50.0% by weight. The THF-insoluble matter B1 in 16-hour extraction and the ODCB-insoluble matter C1 in 6-hour extraction at 185° C. may be in a difference (insoluble-matter quantity B1−insoluble-matter quantity C1) of from 10.0 to 30.0% by weight, and preferably from 10.0 to 25.0% by weight. These differences in insoluble-matter quantity represent differences by extraction time and heat in the quantity of dissolution of insoluble matters contained in the toner. These components are considered to be insoluble matters formed by entanglements of long-chain molecules, which turn into soluble components when entanglements of molecules come loose as a result of the lapse of time of extraction with a solvent and the rise of temperature of the solvent.

In addition, in the toner of the present invention, the components A1, B1 and C1 satisfy the expression (1) of A1>B1>C1. As shown by the expression (1), each insoluble matter decreases with the lapse of time of extraction with a solvent and the kinds of the solvent. From this fact also, the insoluble matter in the present invention is considered to be insoluble matter formed by the entanglements of long-chain molecules.

The resin components contained in the toner of the present invention can be classified into the following four types.

(1) A component soluble in THF in 6-hour extraction (A2): 35.0 to 80.0% by weight.

(2) A component insoluble in THF in 6-hour extraction but soluble in THF in 16-hour extraction (A1−B1): 10.0 to 55.0% by weight.

(3) A component insoluble in THF in 16-hour extraction but soluble in ODCB in 6-hour extraction (B1–C1): 9.5 to 29.5% by weight.

(4) a component insoluble in ODCB (C1): 0.5 to 3.0% by weight.

The component (1), i.e., A2 is a component effective for low-temperature fixing. Hence, if it is not present in the desired quantity, any sufficient low-temperature fixing performance can not be satisfied.

Then, the component (2) (A1–B1) is a component formed by the entanglements of long-chain molecules as stated above, but it is a component in which the entanglements are relatively weak. Hence, the component (2) plays a role which is intermediate between the components (1) and (3), and also has the effect of making the both components mix with ease. If this component (2) is less than 10.0% by weight, the components (1) and (3) may poorly mix, so that the component (3) may thermally act with difficulty at fixing temperature, resulting in a lowering of toner releasability. If on the other hand it is more than 55.0% by weight, other components come present in a small quantity, so that both the low-temperature fixing performance and the high-temperature anti-offset properties which are characteristic of the toner of the present invention can not sufficiently be exhibited.

Among the THF-insoluble matters, the component (3) soluble in ODCB (B1–C1) turns into a soluble component upon extraction with ODCB at 185° C. Hence, it is a component formed by relatively strong entanglements of long-chain molecules, and has operation and effect which are characteristic of the toner of the present invention.

THF-insoluble matter in toners having conventional polyester resins has a softening point which is apart from that of low-molecular-weight resins effective for low-temperature fixing, and hence the insoluble matter takes thermal behavior with difficulty at the time of low-temperature fixing of toner, and can not sufficiently exhibit anti-offset performance. The insoluble matter, which has no thermal solubility, also acts as a filler, and hence may obstruct the motion of the resin component in the toner, also damaging the low-temperature fixing performance.

On the other hand, the component (3) has a softening point which is close to that of the low-molecular-weight resin, and can readily take the thermal behavior even in the low-temperature region. In addition, it also has a superior thermal solubility and has a soft elasticity, and hence it by no means damage the low-temperature fixing performance and also satisfy the high-temperature anti-offset properties. Moreover, the entanglements come loose by heat and can readily mix with other components such as a magnetic material and a release agent. Hence, a toner also having superior developing performance can be provided. In addition, different from conventional hard THF-insoluble matter, it has suitable elasticity, and hence it also has superior pulverizability. If this component is present in an amount of less than 9.5% by weight, the toner may have unsatisfactory high-temperature anti-offset properties. If it is in an amount of more than 29.5% by weight, the toner may have an inferior low-temperature fixing performance.

Finally, the component (4), which is insoluble also in ODCB, is a highly cross-linkable component having a strong elasticity, and hence has a superior thermal stability. Hence, its presence in the toner in a small quantity enables maintenance of high-quality image formation over a long period of time even in a severe environment of high temperature and high humidity. However, if this component is in a insoluble-matter quantity of more than 3.0% by weight, it may affect the low-temperature fixing performance of toner, and may mix with the low-softening resin with difficulty, further resulting in a poor pulverizability to cause liberated resin powder, undesirably.

The B1 is an essential component for satisfying anti-offset properties, and the anti-offset properties can be more improved by controlling the proportion of B1 to C1, B1/C1, to be from 0.06 to 0.15. If the B1/C1 is outside the range of from 0.06 to 0.15, the balance of the both insoluble matters may be lost to make them mix with fixing components with difficulty, making it impossible to attain a broad latitude with regard to the low-temperature fixing performance and anti-offset properties which are characteristic of the present invention.

When the toner contains in the binder resin component from 20.0 to 65.0% by weight of the THF(tetrahydrofuran)-insoluble matter A1 in 6-hour extraction, from 35.0 to 80.0% by weight of the THF-soluble matter A2 in 6-hour extraction, from 10.0 to 30.0% by weight of the THF-insoluble matter B1 in 16-hour extraction and from 70.0 to 90.0% by weight of the THF-soluble matter B2 in 16-hour extractions, and also contains in the binder resin component from 0.5 to 3.0% by weight of the ODCB (orthodichlorobenzene)-insoluble matter C1 in 6-hour extraction at 185° C. and from 97.0 to 99.5% by weight of an ODCB-soluble matter C2 in 6-hour extraction at 185° C., and the proportion of C1 to B1, C1/B1, is from 0.06 to 0.15, and further the A1, B1 and C1 satisfy the expression (1) shown below, both the low-temperature fixing performance and the high-temperature anti-offset properties can be achieved, the toner can have superior storage stability and pulverizability in toner production, and also high-quality image formation can be maintained over a long period of time even in a severe environment of high temperature and high humidity.

$$A1>B1>C1. \qquad \text{Expression (1)}$$

The THF(tetrahydrofuran)-insoluble matter and ODCB (orthodichlorobenzene)-insoluble matter in the present invention are meant to be what has been calculated according to the following methods.

THF-Insoluble Matter of Resin:

The resin is weighed in an amount of about 1.0 g, which is then put in a cylindrical filter paper (e.g., No. 86R of 28 mm×100 mm in size, available from Toyo Roshi K.K.) and set on a Soxhlet extractor. Extraction is carried out for 16 hours using 200 ml of THF as a solvent. Here, the extraction is carried out at such a reflux rate that the extraction cycle of the solvent may come to about 4 minutes to about 5 minutes. After the extraction, the cylindrical filter paper is taken out, and then dried at 40° C. under vacuum for 8 hours, where the extraction residue is weighed. The insoluble matter is one expressed by (W2/W1)×100 (% by weight) where the weight of the resin component introduced first is represented by W1 g, and the weight of the extraction residue by W2 g. Where a wax has internally been added to the resin, it may be calculated according to the above expression on the bases of-the weight (W1 g) found when the weight of the wax is subtracted from the weight of the sample introduced first and the weight (W2 g) found when the weight of the wax is subtracted from the weight of the extraction residue.

THF-Insoluble Matter and THF-Soluble Matter of Toner:

The toner is weighed in an amount of about 2.0 g, which is then put in a cylindrical filter paper (e.g., No. 86R of 28 mm×100 mm in size, available from Toyo Roshi K.K.) and set on a Soxhlet extractor. Extraction is carried out for 6 hours or 16 hours using 200 ml of THF as a solvent. Here, the extraction is carried out at such a reflux rate that the extraction cycle of the solvent may come to about 4 minutes to about 5 minutes. After the extraction, the cylindrical filter paper is taken out, and then dried at 40° C. under vacuum for 8 hours, where the extraction residue is weighed. The insoluble matter is one expressed by (W2/W1)×100 (% by weight) where the weight of the resin component of the toner, introduced first, is represented by W1 g, and the weight of the resin component in the extraction residue by W2 g. For example, it may be calculated according to the above expression on the bases of i), in the case of a magnetic toner, the weight (W1 g) found when the weight of THF-insoluble components other than the resin, such as a magnetic material, a pigment and a wax, is subtracted from the weight of a sample toner or, in the case of a non-magnetic toner, the weight (W1 g) found when the weight of THF-insoluble components other than the resin, such as a pigment, is subtracted from the weight of the sample toner and ii) the weight (W2 g) found when the weight of THF-insoluble components such as the magnetic material, the pigment and the wax is subtracted from the weight of the extraction residue.

The THF-soluble matter of the toner in 6-hour extraction and 16-hour extraction may also be calculated according to the following expression (2):

$$[1-(W2/W1)]\times 100 \text{ (\% by weight).}$$

ODCB-Insoluble Matter and ODCB-Soluble Matter of Toner:

The toner is weighed in an amount of about 2.0 g, which is then put in a cylindrical filter paper (e.g., No. 86R of 20 mm×90 mm in size, available from Toyo Roshi K.K.). This is put against the inner wall of an egg-plant type flask to the top of which a condenser is connected. Extraction is carried out at 185° C. for 6 hours using 200 ml of orthodichlorobenzene (ODCB) as a solvent. After the extraction, the cylindrical filter paper is taken out, and then dried at 150° C. under vacuum for 8 hours, where the extraction residue is weighed. The insoluble matter is one expressed by (W3/W1)×100 (% by weight) where the weight of the resin component in the toner, introduced first, is represented by W1 g, and the weight of the resin component in the extraction residue by W3 g. For example, it may be calculated according to the above expression on the bases of i), in the case of a magnetic toner, the weight (W1 g) found when the weight of orthodichlorobenzene(ODCB)-insoluble components other than the resin, such as a magnetic material, a pigment and a wax, is subtracted from the weight of a sample toner or, in the case of a non-magnetic toner, the weight (W1 g) found when the weight of ODCB-insoluble components other than the resin, such as a pigment, is subtracted from the weight of a sample toner and ii) the weight (W3 g) found when the weight of ODCB-insoluble components such as the magnetic material, the pigment and the wax is subtracted from the weight of the extraction residue.

The ODCB-soluble matter of the toner in 6-hour extraction may also be calculated according to the following expression (3):

$$[1-(W3/W1)]\times 100 \text{ (\% by weight).}$$

To obtain the toner as aimed in the present invention, the polyester resin used as the binder resin must be designed as a resin containing the THF-insoluble matter in an amount of from 10.0 to 70.0% by weight and having solvent-insoluble matter whose entanglements may come loose by heat. As a preferable polyester resin, it may include condensation products of polyhydric hydroxyl compounds with polybasic carboxylic acids, and has the composition as shown below.

As a dihydric alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, hydrogenated bisphenol A, a bisphenol derivative represented by the formula (A):

(A)

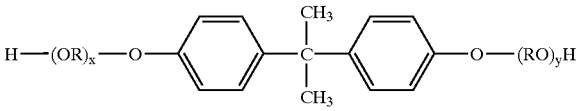

wherein R represents an ethylene group or a propylene group, x and y are each an integer of 0 or more, and an average value of x+y is 0 to 10; and a diol represented by the formula (B):

(B)

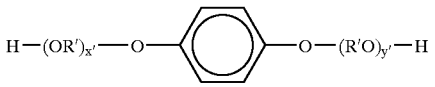

wherein R′ represents

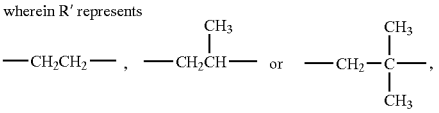

x' and y' are each an integer of 0 or more, and an average value of x'+y' is 0 to 10.

In particular, 2 to 8 mole alkylene oxide addition products of bisphenols are preferred, and 2 to 4 mole ethylene oxide addition products of bisphenols or 2 to 4 mole propylene oxide addition products of bisphenols are more preferred as being capable of providing good anti-offset properties.

As a dibasic acid component, it may include dicarboxylic acids and derivatives thereof as exemplified by benzene dicarboxylic acids such as phthalic acid, terephthalic acid, isophthalic acid and phthalic anhydride, or anhydrides or lower alkyl esters thereof; alkyldicarboxylic acids such as succinic acid, adipic acid, sebacic acid and azelaic acid, or anhydrides or lower alkyl esters thereof; alkenylsuccinic acids or alkylsuccinic acids such as n-dodecenylsuccinic acid and n-dodecylsuccinic acid, or anhydrides or lower alkyl esters thereof; unsaturated dicarboxylic acids such as fumaric acid, maleic acid, citraconic acid and itaconic acid, or anhydrides or lower alkyl esters thereof. Of these, maleic acid (anhydride), fumaric acid, isophthalic acid, terephthalic acid and n-dodecenylsuccinic acid are preferred. In particular, maleic acid (anhydride) and fumaric acid are more preferred as having rich reactivity. Isophthalic acid and terephthalic acid are also more preferred as having the action to elevate the glass transition temperature of the polyester resin and hence contribute to anti-blocking properties, to lessen the dependence of toner charge quantity on environment that is due to temperature, humidity and so forth, and to keep the toner from sticking to toner fixing members.

The polyester resin may preferably also contain a trihydric, tetrahydric or higher alcohol component and/or a tribasic, tetrabasic or higher acid component serving also as cross-linking components.

The trihydric alcohol component may include aliphatic polyhydric alcohols such as glycerol, trimethylolethane and trimethylolpropane; C2 to C4 alkylene oxide (such as ethylene oxide, propylene oxide and butylene oxide) addition products of these aliphatic polyhydric alcohols; novolak resins such as phenol novolak and cresol novolak, having a number of units of three; and C2 to C4 alkylene oxide addition products of these novolak resins.

The tetrahydric or higher alcohol component may include aliphatic polyhydric alcohols such as pentaerythritol and sorbitol; C2 to C4 alkylene oxide (such as ethylene oxide, propylene oxide and butylene oxide) addition products of these aliphatic polyhydric alcohols; novolak resins such as phenol novolak and cresol novolak, having a number of units of four; and C2 to C4 alkylene oxide addition products of these novolak resins.

Of these, preferred are the alkylene oxide addition products of aliphatic polyhydric alcohols and the alkylene oxide addition products of novolak resins. Particularly preferred is an alkylene oxide addition product of novolak resin, represented by the formula (C).

(C)

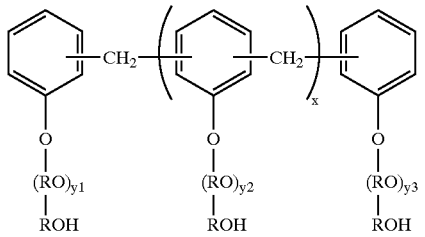

wherein R represents an ethylene group or a propylene group, x is a number of 0 or more, and y1 to y3 are each the same or different number.

This alkylene oxide addition product of novolak resin is effective because it can make the THF-insoluble matter into an entangled-type insoluble matter. With an increase in the number of moles of addition of the alkylene oxide addition product, it has longer branches at cross-linking points to have structures which can be more readily entangled. Its number-average number of moles of addition may preferably be from 3 to 6, and more preferably from 4 to 40. In the novolak resin, its number-average number of units of phenols may usually be from 3 to 60, preferably from 4 to 20, and more preferably from 4 to 15. The alkylene oxide addition product having the number of moles of addition within the above range is preferable because it can have cross-linking points in a larger number than trihydric or lower alcohols and the resin molecules can be entangled in a higher density.

As a tribasic carboxylic acid component in the present invention, it may include, e.g., trimellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, Empol trimer acid, and anhydrides or lower alkyl esters of these.

As a tetrabasic or higher, polybasic carboxylic acid component, it may include polybasic carboxylic acids and derivatives thereof, such as tetra(methylenecarboxyl) methane, pyromellitic acid, 1,2,7,8-octanetetracarboxylic acid, and anhydrides or lower alkyl esters of these; and a tetracarboxylic acid represented by the formula (D):

(D)

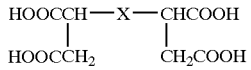

(wherein X represents an alkylene group or alkenylene group having 5 to 30 carbon atoms which has at least one side chain having 3 or more carbon atoms), and anhydrides or lower alkyl esters thereof.

Of the foregoing, 1,2,4-benzenetricarboxylic acid, 1,2,5-benzenetricarboxylic acid and anhydrides or lower alkyl esters of these are preferred.

Of these, trimellitic acid or an anhydride or lower alkyl ester thereof is preferred because it can provide an appropriate elasticity, is available at a low price and can provide anti-offset properties.

The alcohol component used in the present invention may preferably be in an amount of from 40 to 60 mol %, and preferably from 45 to 55 mol % based on all components; and the acid component, from 60 to 40 mol %, and preferably from 55 to 45 mol % based on all components.

In order to have the component (2) in the amount of from 10.0 to 55.0% by weight, the tetrahydric or higher, polyhydric alcohol component may further preferably be in an amount of from 0.5 to 40 mol % of the whole components. If it is less than 0.5 mol %, a sufficiently entangled-type insoluble matter may be obtained with difficulty. If on the other hand it is more than 40% by weight, the entangled-type insoluble matter may come too much to obtain the effect of the present invention with ease.

The polyester resin in the present invention may be obtained by conventionally commonly known condensation polymerization. However, especially after the reaction has been completed, it is more preferable to cool the reaction product slowly. Stated specifically, after the reaction has been completed, it is preferable that the temperature is dropped at a cooling rate of 1° C./min or less, then retained at a constant temperature for several hours on the way to cooling, and thereafter dropped to room temperature. This is because the insoluble matter becomes slowly entangled together to increase in entanglement density. If the retention time is short, a low entanglement density may result, and hence any sufficient anti-offset properties may not be exhibited. Also, if the temperature is dropped in rapid cooling at a cooling rate of more than 1° C./min, the water content produced upon condensation polymerization may not sufficiently be volatilized to remain in the resin, so that the resin components (1) and (3) may poorly mix, resulting in a poor releasability of the toner.

The polyester resin obtained from the above monomers may have a softening point of from 80 to 160° C., and preferably from 85 to 140° C. If it has a softening point of lower than 80° C., the toner may have poor high-temperature anti-offset properties. If it has a softening point of higher than 160° C., it may make poor the fixing performance and the pulverizability in toner production.

The polyester resin may preferably have a glass transition temperature of from 40 to 90° C., and more preferably from 45 to 85° C.

The polyester resin may preferably have an acid value of from 1 to 60 mg.KOH/g, more preferably from 2 to 55 mg.KOH/g, and still more preferably from 5 to 50 mg.KOH/g, and may preferably have an OH value (hydroxyl value) of from 2 to 80 mg.KOH/g, more preferably from 5 to 70 mg.KOH/g, and still more preferably from 10 to 60 mg.KOH/g.

If the polyester resin has an acid value of less than 1 mg.KOH/g, the toner may have a sufficient charge quantity with difficulty. If it has an acid value of more than 60 mg.KOH/g, the toner may be improved in charge quantity but tends to come to have a poor environmental stability. If the polyester resin has an OH value of less than 2 mg.KOH/g, it may poorly be dispersed in the binder resin, and a charge control agent and a colorant may also poorly be dispersed, resulting in non-uniform charging of the toner. If the polyester resin has an OH value of more than 80 mg.KOH/g, associated matter of OH groups may be much formed. Hence, the toner may be attacked by water content, and therefore tends to have a low environmental stability.

The polyester resin in the present invention may also preferably be one having, in its molecular-weight distribution measured by GPC (gel permeation chromatography) of its THF-soluble matter, a peak in the region of molecular weight of from 3,000 to 20,000, and more preferably in the region of molecular weight of from 3,000 to 15,000. If the peak in the molecular-weight distribution measured by GPC of the THF-soluble matter is present in a region lower than the molecular weight of 3,000, the toner may have a poor powder fluidity. If the peak is present in a region higher than the molecular weight of 20,000, the toner may have a poor low-temperature fixing performance. Incidentally, the molecular weight herein referred to is a value in terms of styrene.

The polyester resin in the present invention may further preferably have, in a chromatogram in measurement by GPC of the THF-soluble matter of the toner, a main peak in the region of molecular weight of from 3,000 to 10,000. If its main peak is outside this range, the toner may have a poor low-temperature fixing performance.

In the present invention, any of other polyester resins, modified polyester resins, vinyl resins, polyurethanes, epoxy resins, polyvinyl butyral, rosins, modified rosins, terpene resins, phenolic resins, aliphatic or alicyclic hydrocarbon resins, aromatic petroleum resins and so forth may optionally be used in mixture with the polyester resin described above.

Properties or characteristics according to the present invention are measured by the methods shown below.

(1) Measurement of Softening Point:

1 g of a resin is precisely weighed out, and then pressed for 5 minutes at 2,940 N (a load of 300 kg) to mold it into a column-like tablet of 1 $cm^2$ in cross-sectional area. This molded sample is measured with a flow tester CFT-500C (manufactured by Shimadzu Corporation) under the following conditions. The temperature corresponding to ½ of the height in the flow curve at from the flow start point to the flow end point is regarded as the softening point.

Measuring Conditions

Load: 196 N (20 kg).

Orifice: 1 mm in diameter, 1.0 mm in length.

Heating temperature: 6° C./min.

Measurement start temperature: 75° C.

Preheating time: 300 seconds.

(2) Glass Transition Temperature Tg:

Measured according to ASTM D3418-82, using a differential thermal analyzer (differential scanning calorimeter, DSC measuring instrument) DSC-7 (manufactured by Perkin-Elmer Corporation) or DSC2920 (manufactured by TA Instruments Japan, Ltd.).

A sample for measurement is precisely weighed in an amount of 5 to 20 mg, preferably 10 mg. This sample is put in a pan made of aluminum and an empty aluminum pan is used as reference. Measurement is made in a normal-temperature normal-humidity environment (25° C., 60% RH) at a heating rate of 10° C./min within the measurement temperature range of from 30° C. to 200° C. In the course of this heating, a main-peak endothermic peak of the DSC curve is obtained in the temperature range of from 40° C. to 100° C. The point at which the line showing a middle point of the base line before and after the appearance of the endothermic peak thus obtained and the differential thermal curve intersect is regarded as the glass transition temperature Tg.

(3) Acid Value and Hydroxyl Value of Resin:

Measurement of Acid Value

Measured according to the measuring method prescribed in JIS K0070-1992.

Measuring instrument: Automatic potentiometric titrator AT-400 (manufactured by Kyoto Denshi K.K.).

Calibration of instrument: A mixed solvent of 120 ml of toluene and 30 ml of ethanol is used.

Measurement temperature: 25° C.

Preparation of sample: 0.5 g of the toner (0.3 g in the case of ethyl-acetate-soluble matter) is added to 120 ml of toluene, followed by stirring at room temperature (about 25° C.) for about 10 hours to effect dissolution. Further, 30 ml of ethanol is added to make a sample solution.

Measurement of OH Value (Hydroxyl Value)

0.5 g of the resin is precisely weighed out in a 100 ml of measuring flask, and 5 ml of an acetylating reagent is added thereto. Thereafter, this flask is immersed in a bath of 100° C.±5° C. and heated. After 1 to 2 hours, the flask is taken out of the bath, and then left to cool, followed by addition of water and then shaking to decompose acetic anhydride in the acetylating reagent. To further perfect the decomposition, the flask is again heated in the bath for 10 minutes or more, and then left to cool. Thereafter, the wall of the flask is well washed with an organic solvent. The resulting solution is subjected to potential difference titration with an ethyl alcohol solution of N/2 potassium hydroxide, using glass electrodes, to determine the OH value (according to JIS K0070-1966).

(4) Measurement of Molecular Weight of Resin or Toner:

The molecular weight of a chromatogram is measured by gel permeation chromatography (GPC) under the following conditions.

Columns are stabilized in a heat chamber of 40° C. To the columns kept at this temperature, THF (tetrahydrofuran) as a solvent is made to flow at a flow rate of 1 ml per minute. The resin and/or the toner is dissolved in THF, and the solution formed is adjusted to a concentration of from 0.05 to 0.60% by weight, followed by leaving in a normal-temperature and normal-humidity environment (25° C., 60% RH) for 48 hours. Thereafter, this is filtered with a filter of 0.2 μm in pore size, and the resultant filtrate is used as a sample. From 50 to 200 μl of the sample solution is injected to make measurement. In measuring the molecular weight of the sample, the molecular-weight distribution ascribed to the sample is calculated from the relationship between the logarithmic value of a calibration curve prepared using several kinds of monodisperse polystyrene standard samples and the count number. As the standard polystyrene samples used for the preparation of the calibration curve, it is suitable to use samples with molecular weights of 600, 2,100, 4,000, 17,500, 51,000, 110,000, 390,000, 860,000, 2,000,000 and 4,480,000, which are available from Pressure Chemical Co. or Tosoh-Corporation, and to use at least about 10 standard polystyrene samples. An RI (refractive index) detector is used as a detector.

As columns, in order to make precise measurement in the region of molecular weight from 1,000 to 2,000,000, it is desirable to use a plurality of commercially available polystyrene gel columns in combination. For example, they may preferably comprise a combination of μ-STYRAGEL 500, 1,000, 10,000 and 100,000, available from Waters Co., and SHODEX KA-801, KA-802, KA-803, KA-804, KA-805, KA-806 and KA-807, available from Showa Denko K.K.

From the viewpoint of low-temperature fixing performance, it is more preferable to mix a release agent having a softening point in the region of ±30° C. of that of the polyester resin.

The release agent usable in the present invention may be any of the following. It may include, e.g., aliphatic hydrocarbon waxes such as low-molecular weight polyethylene, low-molecular weight polypropylene, polyolefin copolymer, polyolefin wax, microcrystalline wax, paraffin wax and Fischer-Tropsh wax; oxides of aliphatic hydrocarbon waxes, such as polyethylene oxide wax; or block copolymers of these; vegetable waxes such as candelilla wax, carnauba wax, japan wax (haze wax) and jojoba wax; animal waxes such as bees wax, lanolin and spermaceti; mineral waxes such as ozokelite, serecin and petrolatum; waxes composed chiefly of a fatty ester, such as montanate wax and caster wax; and those obtained by subjecting part or the whole of a fatty acid to deoxidation, such as deoxidized carnauba was. It may further include saturated straight-chain fatty acids such as palmitic acid, stearic acid, montanic acid and also long-chain alkylcarboxylic acids having a long-chain alkyl group; unsaturated fatty acids such as brassidic acid, eleostearic acid and parinaric acid; saturated alcohols such as stearyl alcohol, eicosyl alcohol, behenyl alcohol, carnaubyl alcohol, ceryl alcohol, melissyl alcohol and also long-chain alkyl alcohols having a long-chain alkyl group; polyhydric alcohols such as sorbitol; fatty acid amides such as linolic acid amide, oleic acid amide and lauric acid amide; saturated fatty bisamides such as methylenebis(stearic acid amide), ethylenebis(capric acid amide), ethylenebis(lauric acid amide) and, hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebasic acid amide; aromatic bisamides such as such as m-xylenebisstearic acid amide and N,N'-distearylisophthalic acid amide; fatty acid metal salts (those commonly called metal soap) such as calcium stearate, calcium laurate, zinc stearate and magnesium stearate; grafted waxes obtained by grafting vinyl monomers such as styrene or acrylic acid to fatty acid hydrocarbon waxes; partially esterified products of polyhydric alcohols with fatty acids, such as monoglyceride behenate; and methyl esterified product having a hydroxyl group, obtained by hydrogenation of vegetable fats and oils.

Waxes obtained by making these waxes have sharp molecular-weight distribution by press sweating, solvent fractionation, recrystallization, vacuum distillation, ultracritical gas extraction or molten-liquid crystallization, or low-molecular-weight solid fatty acids, low-molecular-weight solid alcohols, low-molecular-weight solid compounds and other waxes from which impurities have been removed may also preferably be used.

The wax used in the present invention may preferably have a ratio of weight-average molecular weight (Mw) to number-average molecular weight (Mn) which are measured by GPC, Mw/Mn, of from 1.0 to 2.0, more preferably from 1.0 to 1.8, and still more preferably from 1.0 to 1.5, and have a sharp molecular-weight distribution. If it has an Mw/Mn of more than 2.0, the wax may have insufficient dispersibility in the toner of the present invention, tending to make the toner have a poor storage stability and to contaminate members such as a photosensitive member and so forth to cause deterioration of durability, to make it difficult to obtain stable and good images.

The toner of the present invention may also preferably contain the wax so as to have, in its differential thermal analysis, at least one endothermic peak at from 60 to 120° C., preferably from 70 to 115° C., and more preferably from 90 to 110° C. If the toner has an endothermic peak at less than 60° C., the toner may have low anti-blocking properties. If on the other hand the toner has an endothermic peak at more than 120° C., the toner may adversely be affected in its low-temperature fixing performance.

Making the wax have sharp molecular-weight distribution and controlling the endothermic peak (melting point of wax) enables effective achievement of what is aimed in the present invention. Such a wax may preferably be added at the time of condensation polymerization for the resin. The addition of the wax at the time of condensation polymerization for the resin makes each soluble matter and insoluble matter mix well with one another, so that the wax can stand better disperse when the toner is made up, the toner can have stable chargeability and good images are obtainable. This is also preferable because the toner may readily effectively exhibit its low-temperature fixing performance and high-temperature anti-offset properties.

The molecular weight and endothermic peak temperature of the wax used in the present invention may be measured by the following method.

Measurement of Molecular Weight of Wax:

Measuring instrument: GPC-150C (manufactured by Waters Co.).

Columns: GMH-HT (available from Tosoh Corporation)

Temperature: 135° C.

Solvent: o-Dichlorobenzene (0.1% ionol-added)

Flow rate: 1.0 ml/min.

Sample: 0.4 ml of a sample with concentration of 0.15 part by weight is injected.

Measured under conditions shown above. The molecular weight of the sample is calculated using a molecular-weight calibration curve prepared from a monodisperse polystyrene standard sample. The molecular weight of the wax is further calculated by converting the resultant value according to a conversion equation derived from the Mark-Houwink viscosity equation.

Measurement of Temperature of Endothermic Peak of Wax:

The temperature of endothermic peak of the wax is measured according to a temperature measurement pattern of ASTM D3418-82 at a heating rate of 10° C./min, using a differential scanning calorimeter DSC-7 (manufactured by Perkin-Elmer Corporation) or DSC2920 (manufactured by TA Instruments Japan, Ltd.), and is the peak top value of its maximum melting temperature.

Where the wax has a high endothermic peak temperature, it can improve high-temperature anti-offset properties, but has a small effect on low-temperature fixing performance. Moreover, such a wax have so high self-agglomerative force as to have insufficient dispersibility in the resin, and may affect the developing performance.

Where the wax has a low endothermic peak temperature or a broad molecular weight distribution, an ultra-low-molecular weight component of the wax may affect the fluidity and rise of charging, storage stability and transfer performance of the toner.

As the colorant used in the present invention, it may include magnetic iron oxides or metals. As the magnetic iron oxides, usable are oxides such as magnetite, maghematite and ferrite; and as the metals, metals such as iron, cobalt and nickel, or alloys of any of these metals with a metal such as aluminum, cobalt, copper, lead, magnesium, manganese, selenium, titanium, tungsten or vanadium, and mixtures of any of these. Those which contain a non-ferrous metal at particle surfaces or insides of the magnetic iron oxides are preferred.

The magnetic iron oxide used in the present invention may preferably contain a heterogeneous element in an amount of from 0.05 to 10% by weight, and particularly preferably from 0.1 to 5% by weight, based on the iron element.

As the heterogeneous element, it may preferably be an element selected from magnesium, aluminum, silicon, phosphorus and sulfur. In particular, in respect of charging performance, it is favorable for the magnetic iron oxide to contain a silicon element. The heterogeneous element may also include the following metallic elements such as lithium, beryllium, boron, germanium, titanium, zirconium, tin, lead, zinc, calcium, barium, scandium, vanadium, chromium, manganese, cobalt, copper, nickel, gallium, cadmium, indium, silver, palladium, gold, mercury, platinum, tungsten, molybdenum, niobium, osmium, strontium, yttrium and technetium.

The magnetic iron oxide may also preferably be contained in the toner in an amount of from 20 to 200 parts by weight based on 100 parts by weight of the resin component, and particularly preferably from 40 to 150 parts by weight based on 100 parts by weight of the resin component.

The magnetic iron oxide used in the toner of the present invention may also optionally be treated with a silane coupling agent, a titanium coupling agent, a titanate, an aminosilane or the like.

As other colorants usable in the toner of the present invention, they may include any suitable pigments or dyes. The pigments may include carbon black, Aniline Black, acetylene black, Naphthol Yellow, Hanza Yellow, Rhodamine Lake, Alizarine Lake, red iron oxide, Phthalocyanine Blue and Indanethrene Blue. Any of these may be used in an amount necessary for maintaining the optical density of fixed images, and may be added in an amount of from 0.1 part by weight to 20 parts by weight, and preferably from 0.2 part by weight to 10 parts by weight, based on 100 parts by weight of the binder resin. The dyes may include, e.g., azo dyes, anthraquinone dyes, xanthene dyes and methine dyes. Any of the dyes may be added in an amount of from 0.1 part by weight to 20 parts by weight, and preferably from 0.3 part by weight to 10 parts by weight, based on 100 parts by weight of the binder resin.

To the toner of the present invention, a charge control agent or a charge control resin may be added. A charge control agent capable of controlling the toner to be negatively chargeable includes the following materials.

For example, organometallic complexes and chelate compounds are effective, including monoazo metal complexes, acetylyacetone metal complexes, aromatic hydroxycarboxylic acid and aromatic dicarboxylic acid type metal complexes. Besides, they also include aromatic hydroxycarboxylic acid, aromatic mono- and polycarboxylic acids, and metal salts, anhydrides or esters thereof, and phenol derivatives such as bisphenol.

Azo type metal complexes represented by the general formula (1) shown below are preferred.

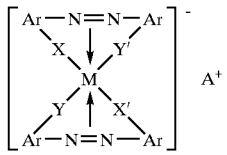

(1)

In the formula, M represents a central metal of coordination, as exemplified by Sc, Ti, V, Cr, Co, Ni, Mn or Fe. Ar represents an aryl group as exemplified by a phenyl group or a naphthyl group, which may have a substituent. In such a case, the substituent includes a nitro group, a halogen atom, a carboxyl group, an anilide group, and an alkyl group or alkoxyl group having 1 to 18 carbon atoms. X, X', Y and Y' each represent —O—, —CO—, —NH— or —NR— (R is an alkyl group having 1 to 4 carbon atoms). $A^+$ represents hydrogen, sodium, potassium, ammonium or aliphatic ammonium.

As the central metal, Fe or Cr is particularly preferred. As the substituent, a halogen atom, an alkyl group or an anilide group is preferred. As counter ions, hydrogen, alkali metal ammonium or aliphatic ammonium is preferred. A mixture of complex salts having different counter ions may also preferably be used.

Instead, basic organic acid metal complex salts represented by the formula (2) shown below are also capable of imparting negative chargeability, and may be used in the present invention.

(2)

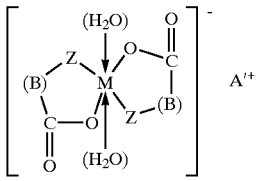

In the formula, M represents a central metal of coordination, as exemplified by Cr, Co, Ni, Mn, Fe, Zn, Al or B. B represents;

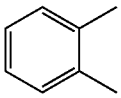

(which may have a substituent such as an alkyl group)

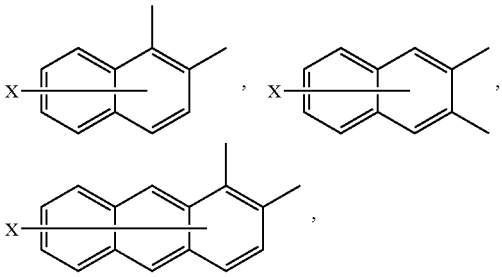

-continued

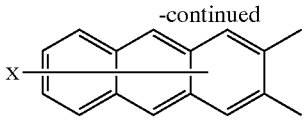

(X represents a hydrogen atom, a halogen atom, a nitro group or an alkyl group), and

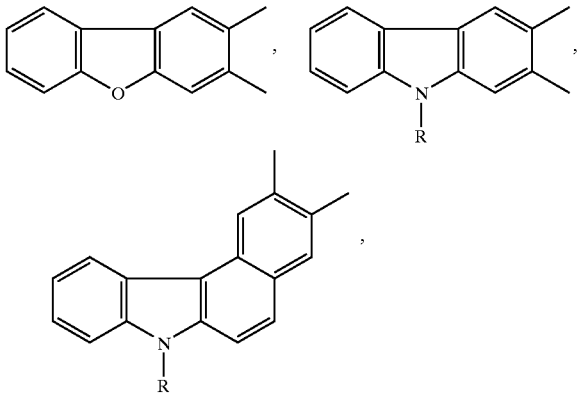

(R represents a hydrogen atom, an alkyl group having 1 to 18 carbon atoms or an alkenyl group having 2 to 18 carbon atoms);

$A'^{+}$ represents hydrogen, sodium, potassium, ammonium, aliphatic ammonium or nothing. Z represents —O— or

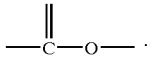

As the central metal, Fe, Cr, Si, Zn or Al is particularly preferred. As the substituent, an alkyl group, an anilide group, an aryl group or a halogen atom is preferred. As counter ions, hydrogen, ammonium or aliphatic ammonium is preferred.

Of these, the azo type metal complexes represented by the formula (1) are more preferred. In particular, azo type metal complexes represented by the formulas (3) are most preferred.

(3)

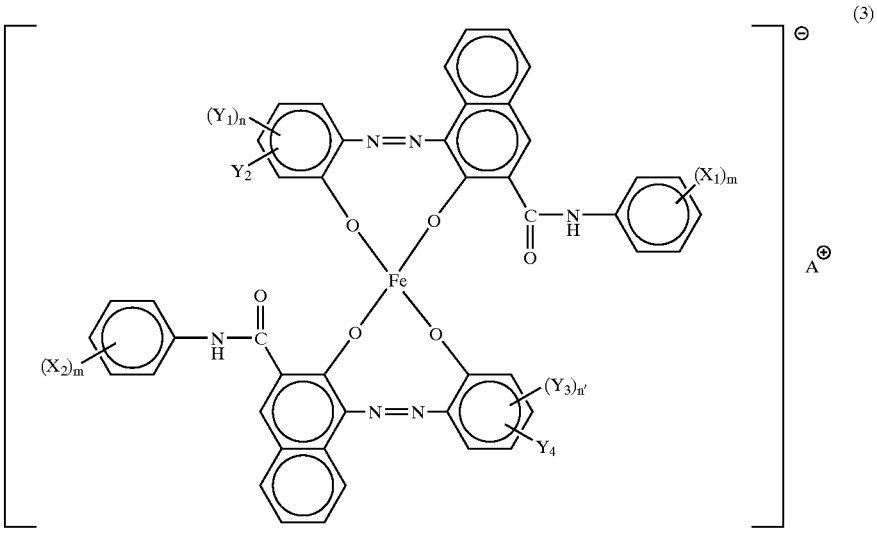

In the formula, $X_1$ and $X_2$ each represent a hydrogen atom, a lower alkyl group, a lower alkoxyl group, a nitro group or a halogen atom; m and m' each represent an integer of 1 to 3; $Y_1$ and $Y_3$ each represent a hydrogen atom, an alkyl group having 1 to 18 carbon atoms, an alkenyl group having 2 to 18 carbon atoms, a sulfonamide group, a mesyl group, a sulfonic acid group, a carboxylate group, a hydroxyl group, an alkoxyl group having 1 to 18 carbon atoms, an acetylamino group, a benzoyl group, an amino group or a halogen atom; n and n' each represent an integer of 1 to 3; $Y_2$ and $Y_4$ each represent a hydrogen atom or a nitro group; (the above $X_1$ and $X_2$, m and m', $Y_1$ and $Y_3$, and n and n', and $Y_2$ and $Y_4$ may respectively be the same or different); and $A^+$ represents an ammonium ion, an alkali metal ion, a hydrogen ion or a mixed ion of any of these.

Specific examples of the complexes are shown below.

Azo type iron complex compound (1):

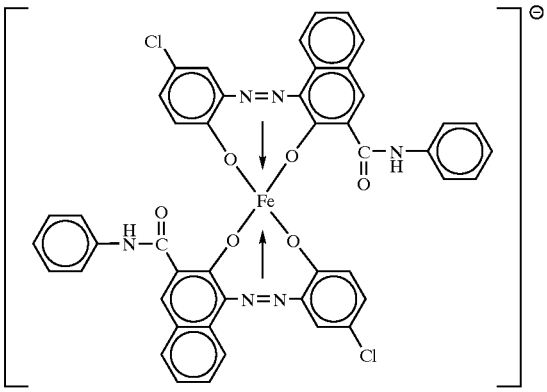

$NH_4^{\oplus}$ (and $H^{\oplus}$, $Na^{\oplus}$, $K^{\oplus}$ or mixed ions of any of these)

Azo type iron complex compound (2):

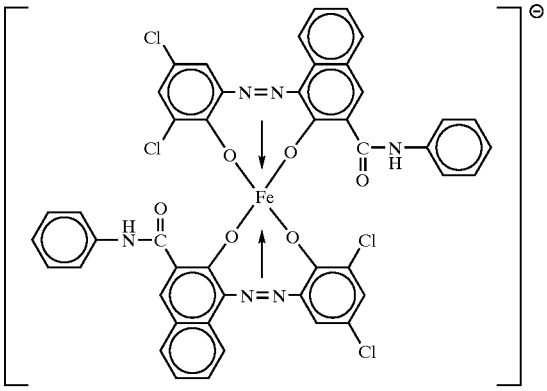

$NH_4^{\oplus}$ (and $H^{\oplus}$, $Na^{\oplus}$, $K^{\oplus}$ or mixed ions of any of these)

Azo type iron complex compound (3):

-continued

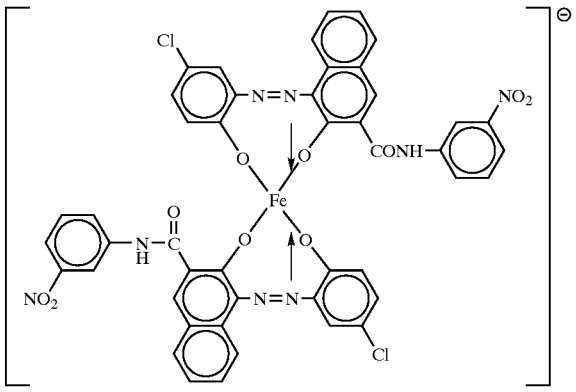

$NH_4^{\oplus}$ (and $H^{\oplus}$, $Na^{\oplus}$, $K^{\oplus}$ or mixed ions of any of these)

In addition, the following commercially available products may also be used. They are chromium complex salt type azo dyes S-32, S-33, S-34, S-35, S-37, S-38, S-40 (available from Orient Chemical Industries, Ltd.); AIZEN SPILON BLACK TRH, BHH (available from Hodogaya Chemical Co., Ltd.); KAYASET BLACK T-22, 004 (available from Nippon Kayaku Co., Ltd.); a copper phthalocyanine dye S-39 (available from Orient Chemical Industries, Ltd.); chromium complex salts E-81, E-82 (available from Orient Chemical Industries, Ltd.); a zinc complex salt E-84 (available from Orient Chemical Industries, Ltd.); an aluminum complex salt E-86 (available from Orient Chemical Industries, Ltd.); and so forth. Of the above charge control agents, as to those having large particle diameters, it is desirable to use those having previously been subjected to treatment such as pulverization so as to be adjusted to have the desired particle diameter.

As the charge control resin, it may include resins having a chargeable functional group such as a carboxyl group, a phenolic hydroxyl group, a naphthoic hydroxyl group, a sulfonic acid group, an amino group or a quaternary ammonium salt.

A charge control agent capable of controlling the toner to be positively chargeable includes the following materials: Nigrosine, and products modified with a fatty acid metal salt; quaternary ammonium salts such as tributylbenzylammonium 1-hydroxy-4-naphthosulfonate and tetrabutylammonium teterafluoroborate, and analogues of these, i.e., onium salts such as phosphonium salts, and lake pigments of these, triphenylmethane dyes and lake pigments of these (laking agents include tungstophosphoric acid, molybdophosphoric acid, tungstomolybdophosphoric acid, tannic acid, lauric acid, gallic acid, ferricyanic acid and ferrocyanic acid), and metal salts of higher fatty acids; diorganotin oxides such as dibutyltin oxide, dioctyltin oxide and dicyclohexyltin oxide; and diorganotin borates such as dibutyltin borate, dioctyltin borate and dicyclohexyltin borate; guanidine compounds, and imidazole compounds. Any of these may be used alone or in combination of two or more kinds. Of these, triphenylmethane dyes compounds and quaternary ammonium salts whose counter ions are not halogens may preferably be used. Homopolymers of monomers represented by the following formula (4);

(4)

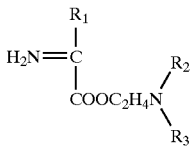

wherein $R_1$ represents H or $CH_3$; $R_2$ and $R_3$ each represent a substituted or unsubstituted alkyl group (preferably having 1 to 4 carbon atoms); or copolymers of polymerizable monomers such as styrene, acrylates or methacrylates may also be used as positive charge control agents. In this case, these charge control agents can also act as binder resins (as a whole or in part).

In particular, compounds represented by the following formula (5) are preferred in the constitution of the present invention.

(5)

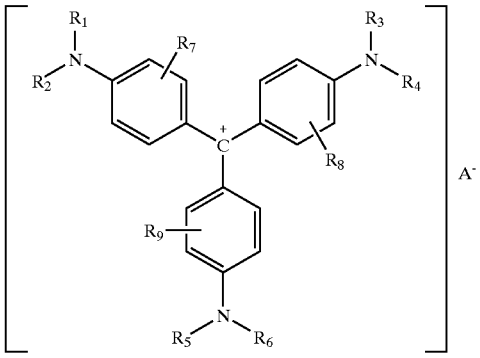

wherein $R_1$, $R_2$, $R_3$, $R_4$, $R_5$ and $R_6$ may be the same or different from one another and each represent a hydrogen atom, a substituted or unsubstituted alkyl group or a substituted or unsubstituted aryl group; $R_7$, $R_8$ and $R_9$ may be the same or different from one another and each represent a hydrogen atom, a halogen atom, an alkyl group or an alkoxyl group; and $A^-$ represents a negative ion selected from a sulfate ion, a nitrate ion, a borate ion, a phosphate ion, a hydroxide ion, an organic sulfate ion, an organic sulfonate ion, an organic phosphate ion, a carboxylate ion, an organic borate ion, or tetrafluoroborate.

As commercially available products, further usable are azine compounds NIGROSINE BASE EX, BONTRON N-01, N-02, N-04, N-05, N-07, N-09, N-10, N-13 (available from Orient Chemical Industries, Ltd.); OIL BLACK (available from Chuo Synthetic Chemical Co., Ltd.); a quaternary ammonium salt P-51, a polyamine compound P-52, SUDAN CHIEF SCHWARZ B B (Solvent Black 3, C.I. No. 26150), FET SCHWARZ (C.I. No. 26150), BRILLIANT SPIRIT SCHWARZ T N (available from Farbenfabriken Bayer GmbH); as well as alkoxylated amines, alkyl amides, molybdic acid chelate pigments, imidazole compounds and so forth.

As methods for incorporating the toner with the charge control agent, there are a method of internally adding it into the toner particles and a method of externally adding it to the toner particles. The amount of the charge control agent used depends on the type of the binder resin, the presence or absence of any other additives, and the manner by which the toner is produced, including the manner of dispersion, and can not absolutely be specified. Preferably, the charge control agent may be used in an amount ranging from 0.1 to 10 parts by weight, and more preferably from 0.1 to 5 parts by weight, based on 100 parts by weight of the binder resin.

Any desired external additive may further optionally be added by means of a Henschel mixer or the like. As the external additive, usable are inorganic fine particles such as fine silica particles, fine titanium oxide particles, fine alumina particles, fine cerium oxide particles and carbon black particle surfaces of all of which have been hydrophobic-treated, and fine particles of polymers such as polycarbonate, polymethyl methacrylate and silicone resin, and so forth, which are fine particles known as external additives.

The toner of the present invention may be produced in the following way: To the binder resin comprised of the polyester resin containing the above THF-insoluble matter, the colorant and further optionally the release agent, the charge control agent and a magnetic powder are added. These are thoroughly mixed by means of a mixing machine such as a Henschel mixer or a ball mill, and then the mixture obtained is melt-kneaded using a heat kneading machine such as a heating roll, a kneader or an extruder to make the resin and so on melt one another, in which the colorant or magnetic material is dispersed. Here, the melt kneading may preferably be carried out under conditions which can keep the entanglement density of insoluble matter that is characteristic of the present invention. After the melt kneading, the kneaded product obtained is cooled to solidify, followed by pulverization and classification. Any desired additive(s) may further optionally thoroughly be mixed by means of a mixing machine such as a Henschel mixer. Thus, the toner of the present invention can be obtained.

As the mixing machine, it may include, e.g., Henschel Mixer (manufactured by Mitsui Mining & Smelting Co., Ltd.); Super Mixer (manufactured by Kawata K.K.); Conical Ribon Mixer (manufactured by Ohkawara Seisakusho K.K.); Nauta Mixer, Turbulizer and Cyclomix (manufactured by Hosokawa Micron K.K.); Spiral Pin Mixer (manufactured by Taiheiyo Kiko K.K.); and Rhoedige Mixer (manufactured by Matsubo K.K.). As the kneading machine, it may include KRC Kneader (manufactured by Kurimoto Tekkosho K.K.); Buss-Kneader (manufactured by Buss Co.); TEM-type Extruder (manufactured by Toshiba Machine Co., Ltd.); TEX Twin-screw Extruder (manufactured by Nippon Seiko K.K.); PCM Kneader (manufactured by Ikegai Tekkosho K.K.); Three-Roll Mill, Mixing Roll Mill, and Kneader (manufactured by Inoue Seisakusho K.K.); Kneadex (manufactured by Mitsui Mining & Smelting Co., Ltd.); MS-type Pressure Kneader, Kneader-Ruder (manufactured by Moriyama Seisakusho K.K.); and Banbury Mixer (manufactured by Kobe Seikosho K.K.). As a grinding machine, it may include Counter Jet Mill, Micron Jet and Inomizer (manufactured by Hosokawa Micron K.K.); IDS-type Mill and PJM Jet Grinding Mill (manufactured by Nippon Pneumatic Kogyo K.K.); Cross Jet Mill (manufactured by Kurimoto Tekkosho K.K.); Ulmax (manufactured by Nisso Engineering K.K.); SK Jet O-Mill (manufactured by Seishin Kigyo K.K.); Criptron (manufactured by Kawasaki Heavy Industries, Ltd); and Turbo Mill (manufactured by Turbo Kogyo K.K.). As a classifier, it may include Classyl, Micron Classifier and Spedic Classifier (manufactured by Seishin Kigyo K.K.); Turbo Classifier (manufactured by Nisshin Engineering K.K.); Micron Separator, Turboprex(ATP) and TSP Separator (manufactured by Hosokawa Micron K.K.); Elbow Jet (manufactured by Nittestsu Kogyo K.K.); Dispersion Sparator (manufactured by Nippon Pneumatic Kogyo K.K.); and YM Microcut (manufactured by Yasukawa Shoji K.K.). As a sifter used to sieve coarse powder and so forth, it may include Ultrasonics (manufactured by Koei Sangyo K.K.); Rezona Sieve and Gyro Sifter (manufactured by Tokuju Kosakusho K.K.); Vibrasonic Sifter (manufactured by Dulton Co.); Sonicreen (manufactured by Shinto Kogyo K.K.); Turbo-Screener (manufactured by Turbo Kogyo K.K.); Microsifter (manufactured by Makino Sangyo K.K.); and circular vibrating screens.

The toner of the present invention, produced in the manner as described above, may be used as a one-component developer, or may be blended with a carrier so as to be used as a two-component developer. Where such developer of the present invention consists of the carrier and the toner, resin-coated carrier (particles) having resin coat layers may preferably be used as the carrier. The resin-coated carrier is one obtained by coating core material surfaces with a resin. The core material may include, e.g., powders having magnetism, such as iron powder, ferrite powder and nickel powder. The resin with which the core material surfaces are to be coated may include, e.g., fluorine resins, vinyl resins and silicone resins.

An example of an image-forming apparatus to which the toner of the present invention is used is described below with reference to FIG. 1.

The surface of an electrostatic latent image bearing member 3 is negatively charged by a contact charging means 11 comprised of a charging roller, serving as a primary charging assembly, and exposed to laser light 5 to form an electrostatic latent image on the electrostatic latent image bearing member 3. The latent image thus formed is developed by reversal development using a negatively triboelectrically chargeable magnetic toner 13 which is held in a developing assembly 1 having a toner container 2, having an elastic blade 8 fastened to toner container 2 with a blade support member 9 and a developing sleeve 6; the former being made of urethane rubber and installed in the counter direction and the latter being internally provided with a magnet 15. Alternatively, an amorphous silicon photosensitive member is used, where the photosensitive member is positively charged to form an electrostatic latent image, which is then developed by normal development using the negatively triboelectrically chargeable magnetic toners. To the developing sleeve an alternating bias, a pulse bias and/or a DC bias is/are kept applied by a bias applying means 12. A transfer paper P is transported to the transfer zone, where a transfer voltage is applied by a contact transfer member 4 to the transfer paper P on its back surface (the surface opposite to the photosensitive drum side); the contact transfer member being comprised of a transfer roller and serving as a transfer means. Thus, the toner image on the surface of the photosensitive drum 3 is transferred to the transfer paper P. The transfer paper P separated from the photosensitive drum 3 is subjected to fixing using a heat-and-pressure fixing assembly having a heating roller 21 and a pressure roller 22, in order to fix the toner image held on the transfer paper P.

The magnetic toner remaining on the electrostatic latent image bearing member (photosensitive drum) 3 after the step of transfer is removed by a cleaning assembly 14 having a cleaning blade 7. After the cleaning, the photosensitive drum 3 is charge-eliminated by erase exposure 10, thus the procedure again starting from the charging step using the contact charging means 11 is repeated.

The electrostatic latent image bearing member (photosensitive drum) 3 has a photosensitive layer and a conductive substrate, and is rotated in the direction of an arrow. The developing sleeve 6 formed of a non-magnetic cylinder, which is a toner-carrying member, is rotated so as to move in the same direction as the surface movement of the electrostatic latent image bearing member in the developing zone. Inside the non-magnetic-cylinder developing sleeve 6, a multi-polar permanent magnet (magnet roll) serving as a magnetic-field generation means is provided in an unrotatable state. The magnetic toner 13 held in the developing assembly 1 is coated on the surface of the non-magnetic cylinder, and negative triboelectric charges are imparted to the magnetic toner as a result of the friction between the surface of the developing sleeve 6 and the magnetic toner's particles. A magnetic doctor blade 8 is also disposed to control the thickness of a toner layer to be small (30 $\mu$m to 300 $\mu$m) and uniform so that the toner layer on the developing sleeve 6 is so formed as to be in non-contact at the developing zone of the electrostatic latent image bearing member, as a toner layer with a thickness smaller than the gap between the photosensitive drum 3 and the developing sleeve 6. The rotational speed of this developing sleeve 6 is regulated so that the peripheral speed of the developing sleeve 6 can substantially be equal to, or close to, the peripheral speed of the surface bearing the electrostatic latent image.

An AC bias or a pulse bias may be applied to the developing sleeve 6 by a bias means 12. This AC bias may have a frequency (f) of from 200 to 4,000 Hz and a Vpp of from 500 to 3,000 V.

When the magnetic toner particles are moved at the developing zone, the magnetic toner particles move to the side of an electrostatically charged image (electrostatic latent image) by the electrostatic force of the surface of the photosensitive drum 3 holding the electrostatically charged image and the action of the AC bias or pulse bias.

From among the above components such as the electrostatic latent image bearing member (such as the photosensitive drum), the developing assembly and the cleaning means, a plurality of components may integrally be joined as an apparatus unit to set up a process cartridge so that the process cartridge is detachably mountable to the body of an image-forming apparatus. For example, the primary charging means and the developing assembly may integrally be supported together with the photosensitive drum to form a process cartridge, which is a single unit that is detachably mountable to the body of the apparatus, and it may be so constructed as to be detachably mountable through a guide means such as rails provided in the body of the apparatus.

Here, the apparatus may be so constructed that the cleaning means is set together on the part of the process cartridge.

Figure 2:
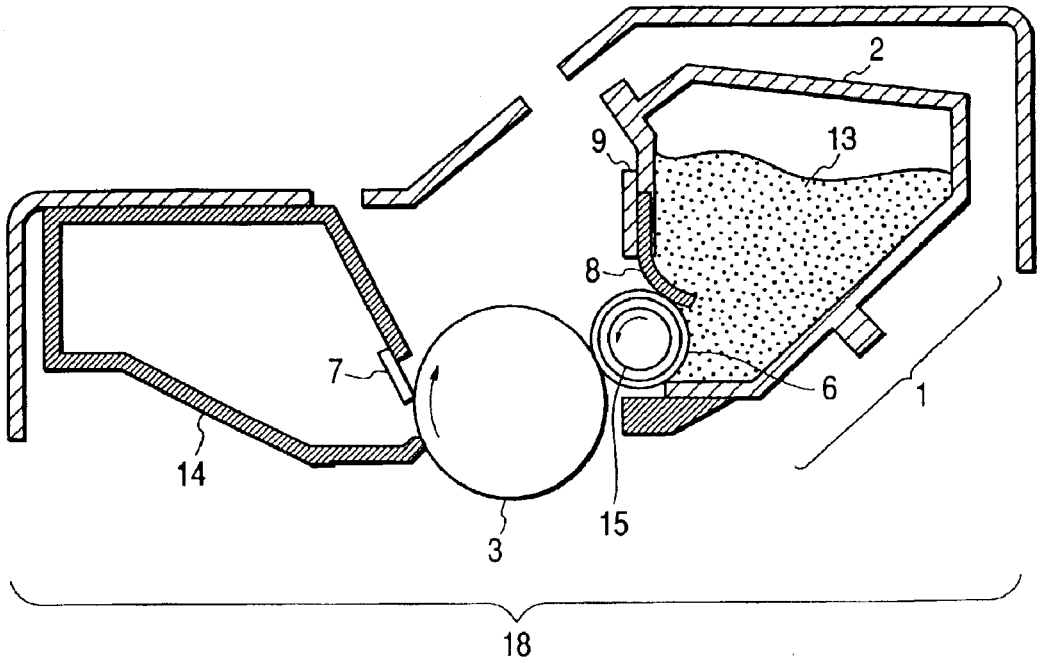
FIG. 2 is a schematic view showing an example of a process cartridge fit to form images by the use of a magnetic toner according to the present invention.

FIG. 2 shows an example of the process cartridge of the present invention. The process cartridge of the present invention has an electrostatic latent image bearing member and a developing means for developing by the use of a toner an electrostatic latent image formed on the electrostatic latent image bearing member, and is detachably mountable to the body of an image-forming apparatus. In this example, a process cartridge 18 is exemplified in which a drum-shaped electrostatic latent image bearing member (photosensitive drum) 3, a cleaner 14 having a cleaning blade 7 and a primary charging assembly are integrally supported.

In use of the process cartridge, it is replaced with a new cartridge when a magnetic toner 13 of the developing assembly 1 has run short.

In this example, the developing assembly 1 has the magnetic toner 13. At the time of development, the distance between the photosensitive drum 3 and a developing sleeve 6 is very important in order that a stated electric field is formed across the photosensitive drum 3 and the developing sleeve 6 and the step of development is favorably carried out. For example, in this example, the distance is so adjusted as to be around 300 $\mu$m and in an error of plus-minus 20 $\mu$m.

In the process cartridge shown in FIG. 2, the developing assembly 1 has a toner container 2 for holding the magnetic toner 13, a developing sleeve 6 on which the magnetic toner 13 in the toner container 2 is carried and transported from the toner container 2 to a developing zone facing the photosensitive drum (electrostatic latent image bearing member) 3, and an elastic blade 8 with which the magnetic toner 13 carried on the developing sleeve 6 and transported to the developing zone is controlled to a stated thickness to form a toner thin layer on the developing sleeve 6.

The developing sleeve 6 may have any desired structure. Usually, it is made up of a non-magnetic developing sleeve 6 provided internally with a magnet 15. The developing sleeve 6 may be a cylindrical rotating member as shown in the drawing, or may be in the shape of a belt, which moves circulatively. As a material therefor, usually, it is preferable to use aluminum or stainless steel.

The elastic blade 8 is formed of an elastic plate comprised of a rubber elastic material such as urethane rubber, silicone rubber or NBR (nitrile-butadiene rubber), a metal elastic material such as phosphor bronze or stainless steel, or a resin elastic material such as polyethylene terephthalate or high-density polyethylene. The elastic blade 8 is brought into touch with the developing sleeve 6 by the elasticity the blade member itself has, and is fastened to the toner container 2 with a blade support member 9 comprised of a rigid material such as iron. The elastic blade 8 may preferably come in touch at a linear pressure of from 5 to 80 g/cm and in the direction counter to the rotational direction of the developing sleeve 6.

As the contact charging member, in place of the charging roller described above, a blade-shaped charging blade may also be used. The toner of the present invention has also the effect that it can keep such a charging blade against its contamination.

EXAMPLES

The present invention is described below in greater detail by giving working examples. The present invention is by no means limited by these.

Polyester Resin Production Example 1

| | (by weight) |
|---|---|
| Bisphenol derivative represented by the formula (A) (R: propylene group; average value of x + y = 2.2) | 67 parts |
| Terephthalic acid | 24 parts |
| Isophthalic acid | 2 parts |
| Trimellitic anhydride | 5 parts |
| 5.6 mol Ethylene oxide addition product of novolak type phenol resin (average number of units: 5.6) (corresponding to 5.6-hydric alcohol) | 2 parts |

To the above materials, 4 parts by weight of polyethylene wax (endothermic peak temperature: 101° C.; Mn: 720; Mw/Mn: 1.33) and 0.5 part by weight of dibutyltin oxide were added, and these were subjected to condensation polymerization at 210° C. The progress of the reaction was followed measuring the acid value, and the reaction was terminated at the point of time where the acid value reached a stated value. Subsequently, this reaction product was annealed on to 180° C. at a cooling rate of 0.5° C./min, and then retained at 180° C. for 5 hours, followed by annealing to room temperature at a cooling rate of 0.5° C./min (cooling method A) to obtain a polyester resin (1) It had a Tg of 56° C., a softening point of 108° C. and THF-insoluble matter in a content of 25.0%. Physical properties of the polyester resin obtained here are shown in Table 2.

Polyester Resin Production Examples 2 to 5

Condensation polymerization of monomers were carried out in the same manner as in Production Example 1 except that the types and quantities (weight ratios) of the carboxylic-acid compounds and alcohol compounds used as raw materials were changed for those shown in Table 1. Thus, polyester resins (2) to (5) shown in Table 2 were prepared.

Polyester Resin Production Example 6

Condensation polymerization of monomers were carried out in the same manner as in Production Example 1 except that the types and quantities (weight ratios) of the carboxylic-acid compounds and alcohol compounds used as raw materials were changed for those shown in Table 1 and polyethylene wax (endothermic peak temperature: 114° C.; Mn: 800; Mw/Mn: 1.70) was used as the wax. Thus, a polyester resin (6) shown in Table 2 was prepared.

Polyester Resin Production Example 7

Condensation polymerization of monomers were carried out in the same manner as in Production Example 1 except that the types and quantities (weight ratios) of the carboxylic-acid compounds and alcohol compounds used as raw materials were changed for those shown in Table 1 and polyethylene wax (endothermic peak temperature: 118° C.; Mn: 850; Mw/Mn: 1.90) was used as the wax. Thus, a polyester resin (7) shown in Table 2 was prepared.

Polyester Resin Production Example 8

Condensation polymerization of monomers were carried out in the same manner as in Production Example 1 except that the types and quantities (weight ratios) of the carboxylic-acid compounds and alcohol compounds used as raw materials were changed for those shown in Table 1 and polyethylene wax (endothermic peak temperature: 125° C.; Mn: 950; Mw/Mn: 2.5) was used as the wax. Thus, a polyester resin (8) shown in Table 2 was prepared.

Polyester Resin Production Examples 9 to 11

Condensation polymerization of monomers were carried out in the same manner as in Production Example 1 except that the types and quantities (weight ratios) of the carboxylic-acid compounds and alcohol compounds used as raw materials were changed for those shown in Table 1, any wax was not added at the time of condensation polymerization for resin and, after the reaction was completed, the reaction product was annealed on to 180° C. at a cooling rate of 0.5° C./min, and then retained at 180° C. for 10 minutes, followed by quenching to room temperature in 3 minutes (cooling method B). Thus, polyester resins (9) to (11) shown in Table 2 were prepared.

Polyester Resin Production Examples 12 to 17

Condensation polymerization of monomers were carried out in the same manner as in Production Example 1 except that the types and quantities (weight ratios) of the carboxylic-acid compounds and alcohol compounds used as raw materials were changed for those shown in Table 1, any wax was not added at the time of condensation polymerization for resin and, after the reaction was completed, the reaction product was quenched to room temperature in 3 minutes (cooling method C). Thus, polyester resins (12) to (17) shown in Table 2 were prepared.

Example 1

| | (by weight) |
|---|---|
| Polyester resin (1) | 100 parts |
| Magnetic iron oxide (particle diameter: 0.2 μm; shape: spherical) | 95 parts |
| Monoazo iron complex (T-77, available from Hodogaya Chemical Co., Ltd.) | 2 parts |

A mixture of the above was melt-kneaded by means of a twin-screw extruder set at 130° C. and 200 rpm. The kneaded product thus obtained and then cooled was crushed by means of a hammer mill. The crushed product obtained was finely pulverized by means of Turbo Mill, and the finely pulverized product thus obtained was classified by means of a fixed-wall type air classifier to obtain a negatively chargeable magnetic toner 1 with a weight-average particle diameter (D4) of 6.8 μm. The THF-soluble matter of this toner had a main-peak molecular weight of 7,500. Also, this toner was obtained in a good pulverizability, and further its insoluble-matter proportion C1/B1 was 0.15. The soluble-matter quantities and insoluble-matter quantities of the toner are shown in Table 3.

100 parts by weight of this magnetic toner and 1.2 parts by weight of hydrophobic fine silica powder were mixed by means of a Henschel mixer to prepare a developer 1.

Example 2

A toner 2 and a developer 2 were obtained in the same manner as in Example 1 except that in place of the polyester resin (1) the polyester resin (2) was used. The THF-soluble matter of this toner had a main-peak molecular weight of 7,700. Also, this toner was obtained in a good pulverizability. Data of this toner are shown together in Table 3.

Example 3

A toner 3 and a developer 3 were obtained in the same manner as in Example 1 except that in place of the polyester resin (1) the polyester resin (3) was used. The THF-soluble matter of this toner had a main-peak molecular weight of 7,500. Also, this toner was obtained in a good pulverizability. Data of this toner are shown together in Table 3.

Example 4

A toner 4 and a developer 4 were obtained in the same manner as in Example 1 except that in place of the polyester resin (1) the polyester resin (4) was used. The THF-soluble matter of this toner had a main-peak molecular weight of 7,700. Also, this toner was obtained in a good pulverizability. Data of this toner are shown together in Table 3.

Example 5

A toner 5 and a developer 5 were obtained in the same manner as in Example 1 except that in place of the polyester resin (1) the polyester resin (5) was used. The THF-soluble matter of this toner had a main-peak molecular weight of 7,700. Also, this toner was obtained in a good pulverizability. Data of this toner are shown together in Table 3.

Example 6

A toner 6 and a developer 6 were obtained in the same manner as in Example 1 except that in place of the polyester resin (1) the polyester resin (6) was used. The THF-soluble matter of this toner had a main-peak molecular weight of 7,700. Also, this toner was obtained in a good pulverizability. Data of this toner are shown together in Table 3.

Example 7

A toner 7 and a developer 7 were obtained in the same manner as in Example 1 except that in place of the polyester resin (1) the polyester resin (7) was used. The THF-soluble matter of this toner had a main-peak molecular weight of 7,700. Also, this toner was obtained in a good pulverizability. Data of this toner are shown together in Table 3.

Example 8

A toner 8 and a developer 8 were obtained in the same manner as in Example 1 except that in place of the polyester resin (1) the polyester resin (8) was used. The THF-soluble matter of this toner had a main-peak molecular weight of 7,800. Also, this toner was obtained in a good pulverizability. Data of this toner are shown together in Table 3.

Comparative Example 1

| | (by weight) |
|---|---|
| Polyester resin (9) | 100 parts |
| Magnetic iron oxide (particle diameter: 0.2 μm; shape: spherical) | 95 parts |
| Monoazo iron complex (T-77, available from Hodogaya Chemical Co., Ltd.) | 2 parts |
| Polyethylene wax (endothermic peak temperature: 125° C.; Mn: 950; Mw/Mn: 2.5) | 4 parts |

A mixture of the above was melt-kneaded by means of a twin-screw extruder set at 100° C. and 250 rpm. The kneaded product thus obtained and then cooled was crushed by means of a hammer mill. The crushed product obtained was finely pulverized by means of a jet grinding mill, and the finely pulverized product thus obtained was classified by means of a fixed-wall type air classifier to obtain a negatively chargeable magnetic toner 9 with a weight-average particle diameter (D4) of 6.8 μm. The THF-soluble matter of this toner had a main-peak molecular weight of 7,900. Also, this toner was obtained in a poor pulverizability.

100 parts by weight of this magnetic toner and 1.2 parts by weight of hydrophobic fine silica powder were mixed by means of a Henschel mixer to prepare a developer 9.

Comparative Example 2

A toner 10 and a developer 10 were obtained in the same manner as in Comparative Example 1 except that in place of the polyester resin (9) the polyester resin (10) was used and the wax added was changed for polypropylene wax (endothermic peak temperature: 150° C.; Mn: 1,900; Mw/Mn: 5.06). The THF-soluble matter of this toner had a main-peak molecular weight of 7,900. Also, this toner was obtained in a poor pulverizability. Data of this toner are shown together in Table 3.

Comparative Example 3

A toner 11 and a developer 11 were obtained in the same manner as in Comparative Example 2 except that in place of the polyester resin (9) the polyester resin (11) was used. The THF-soluble matter of this toner had a main-peak molecular weight of 7,700. Also, this toner was obtained in a good pulverizability. Data of this toner are shown together in Table 3.

Comparative Example 4

A toner 12 and a developer 12 were obtained in the same manner as in Comparative Example 2 except that in place of the polyester resin (9) the polyester resin (12) was used. The THF-soluble matter of this toner had a main-peak molecular weight of 7,900. Also, this toner was obtained in a poor pulverizability. Data of this toner are shown together in Table 3.

Comparative Example 5

A toner 13 and a developer 13 were obtained in the same manner as in Comparative Example 2 except that in place of the polyester resin (9) the polyester resin (13) was used. The THF-soluble matter of this toner had a main-peak molecular weight of 8,500. Also, this toner was obtained in a poor pulverizability. Data of this toner are shown together in Table 3.

Comparative Example 6

A toner 14 and a developer 14 were obtained in the same manner as in Comparative Example 2 except that in place of the polyester resin (9) the polyester resin (14) was used. The THF-soluble matter of this toner had a main-peak molecular weight of 7,500. Also, this toner was obtained in a good pulverizability. Data of this toner are shown together in Table 3.

Comparative Example 7

A toner 15 and a developer 15 were obtained in the same manner as in Comparative Example 2 except that in place of the polyester resin (9) the polyester resin (15) was used. The THF-soluble matter of this toner had a main-peak molecular weight of 7,000. Also, this toner was obtained in a good pulverizability. Data of this toner are shown together in Table 3.

Comparative Example 8

A toner 16 and a developer 16 were obtained in the same manner as in Comparative Example 2 except that in place of the polyester resin (9) the polyester resin (16) was used. The THF-soluble matter of this toner had a main-peak molecular weight of 8,000. Also, this toner was obtained in a poor pulverizability. Data of this toner are shown together in Table 3.

Comparative Example 9

A toner 17 and a developer 17 were obtained in the same manner as in Comparative Example 2 except that in place of the polyester resin (9) the polyester resin (17) was used and the melt-kneading conditions in making the toner were set at 70° C. and 300 rpm. The THF-soluble matter of this toner had a main-peak molecular weight of 6,000. Also, this toner was obtained in a good pulverizability. Data of this toner are shown together in Table 3.

Next, the developers (toners) thus prepared were evaluated in the manner as shown below. The results of evaluation are shown in Table 4.

Evaluation of Image Density:

(Image Reproduction Test)

The above toners were each put into a process cartridge. Using a commercially available laser beam printer LBP-210, manufactured by CANON INC., and using copying plain paper (basis weight: 75 g/m$^2$) as transfer material, image reproduction on 12,000 sheets was tested at a process speed of 4 sheets/minute in A4-paper lengthwise feed and in a high-temperature and high-humidity environment (32.5° C., 80% RH). The density of images obtained was evaluated in the following way.

Image density was evaluated on printed images at the initial stage and those at finish. Here, the image density was measured with MACBETH REFLECTION DENSITOMETER (manufactured by Macbeth Co.), as relative density in respect to a printed image of white background area (i.e., white paper) having a density of 0.00 as an original.

(Severe Leaving Test)

The toners were left at a temperature of 45° C., at a relative humidity (RH) of 90% and for 20 days. Thereafter, these were left in a normal-temperature and normal-humidity environment (25° C., 60% RH) for a day, and, in this environment and using the same apparatus as the above, images were reproduced to ascertain the image density at the initial stage and on 500th sheet.

Low-temperature Fixing Performance and High-temperature Anti-offset Properties:

The above toners were each put into a process cartridge. A fixing assembly of a commercially available laser beam printer LBP-450, manufactured by CANON INC., was detached, and was remodeled into a fixing test equipment fitted with an external drive and a temperature control unit of the fixing assembly so that the surface temperature of a heating roller is changeable from 120° C. to 250° C. from the outside. Solid black images were processed and fixed. Changing the preset temperature at intervals of 5° C., the image sample was printed in a normal-temperature and normal-humidity environment (25° C., 60% RH).

(1) Low-temperature Fixing Performance:

Fixed images were rubbed with soft and gentle thin paper under application of a load of 4.9 kPa (50 g/cm$^2$) The lowest temperature at which the image density decreased by 10% or less as decrease percentage (%) before and after rubbing was evaluated as the lowest fixing temperature, i.e., fixing start temperature. Here, as test paper (transfer paper), copying plain paper (basis weight: 90 g/m$^2$) which was severe for fixing performance was used.

(2) High-temperature Anti-offset Properties:

Images were printed the upper half of which was a pattern of horizontal lines of 100 $\mu$m in width (breadth: 10.0 mm; interval: 1.0 mm) and a solid-black image and the lower half of which was a white image. The highest temperature at which any stains not appeared on the white image was shown in data. As test paper, copying plain paper (basis weight: 60 g/m$^2$) which tended to cause offset was used.

TABLE 1

Polyester Resin Production Examples (parts by weight)

| Resin No. | Cooling method | BPA-PO | EG | TPA | IPA | TMA | I-DSA | PMA | EO-NPR |
|---|---|---|---|---|---|---|---|---|---|
| (1) | A | 67 | 0 | 24 | 2 | 5 | 0 | 0 | 2 |
| (2) | A | 67 | 0 | 24 | 2 | 4 | 0 | 0 | 3 |
| (3) | A | 66 | 1 | 24 | 2 | 5 | 0 | 0 | 2 |
| (4) | A | 68 | 0 | 24 | 2 | 5 | 0 | 0 | 1 |
| (5) | A | 67 | 0 | 24 | 3 | 4 | 1 | 0 | 1 |
| (6) | A | 67 | 0 | 24 | 3 | 4 | 1 | 0 | 1 |
| (7) | A | 67 | 0 | 24 | 3 | 4 | 1 | 0 | 1 |
| (8) | A | 67 | 0 | 24 | 3 | 4 | 1 | 0 | 1 |
| (9) | B | 65 | 3 | 23 | 2 | 4 | 2 | 0 | 1 |
| (10) | B | 46 | 0 | 0 | 0 | 5 | 45 | 0 | 4 |
| (11) | B | 65 | 2 | 24 | 3 | 4 | 1 | 0 | 1 |
| (12) | C | 66 | 2 | 21 | 1 | 7 | 0 | 2 | 1 |
| (13) | C | 62 | 2 | 24 | 4 | 3 | 0 | 0 | 5 |
| (14) | C | 64 | 4 | 25 | 2 | 2 | 2 | 0 | 1 |
| (15) | C | 65 | 2 | 28 | 4 | 0 | 0 | 0 | 1 |
| (16) | C | 67 | 0 | 21 | 2 | 6 | 0 | 2 | 2 |
| (17) | C | 67 | 0 | 24 | 2 | 4 | 0 | 1 | 2 |

BPA-PO: Bisphenol-A propylene oxide addition product; EG: Ethylene glycol; TPA: Terephthalic acid; IPA: Isophthalic acid; TMA: Trimellitic anhydride; I-DSA: Isododecenyl succinic anhydride; PMA: Pyromellitic anhydride; EO-NPR: Novolak type phenol resin ethylene oxide addition product

TABLE 2

Polyester Resin Physical Properties

| Resin No. | THF-insoluble matter | Tg (° C.) | Softening point (° C.) | Acid value (mg · KOH/g) | OH value (mg · KOH/g) | GPO molecular-weight peak |
|---|---|---|---|---|---|---|
| (1) | 25.0% | 56 | 108 | 20 | 30 | 5,800 |
| (2) | 30.0% | 56 | 109 | 19 | 32 | 5,900 |
| (3) | 20.0% | 55 | 107 | 21 | 29 | 5,900 |
| (4) | 13.0% | 55 | 106 | 21 | 30 | 5,900 |
| (5) | 15.0% | 54 | 103 | 20 | 31 | 5,700 |
| (6) | 15.0% | 55 | 104 | 20 | 31 | 5,700 |
| (7) | 15.0% | 55 | 104 | 20 | 31 | 5,800 |
| (8) | 15.0% | 56 | 105 | 20 | 31 | 5,800 |
| (9) | 12.0% | 56 | 105 | 22 | 28 | 5,900 |
| (10) | 22.0% | 57 | 109 | 21 | 31 | 5,700 |
| (11) | 1.0% | 54 | 100 | 24 | 28 | 5,400 |
| (12) | 50.0% | 62 | 115 | 24 | 29 | 5,500 |
| (13) | 5.0% | 52 | 100 | 22 | 32 | 6,000 |
| (14) | 7.0% | 52 | 98 | 18 | 29 | 6,000 |
| (15) | 0.0% | 52 | 95 | 17 | 28 | 5,500 |
| (16) | 20.0% | 64 | 120 | 21 | 33 | 5,400 |
| (17) | 20.0% | 65 | 130 | 21 | 34 | 5,400 |

TABLE 3

| | | Toner Physical Properties | | | | | | | | |
|---|---|---|---|---|---|---|---|---|---|---|
| | | Soluble matter | | | Insoluble matter | | | | | |
| | Toner No. | 6 hr THF = soluble matter A2 (wt. %) | 16 hr THF = soluble matter B2 (wt. %) | ODCB = soluble matter C2 (wt. %) | 6 hr THF = insoluble matter A1 (wt. %) | 16 hr THF = insoluble matter B1 (wt. %) | ODCB = insoluble matter C1 (wt. %) | C1/B1 | A1-B1 (wt. %) | B1-C1 (wt. %) |
| Example: | | | | | | | | | | |
| 1 | 1 | 59.0 | 80.0 | 97.0 | 41.0 | 20.0 | 3.0 | 0.15 | 21.0 | 17.0 |
| 2 | 2 | 55.0 | 72.0 | 98.0 | 45.0 | 28.0 | 2.0 | 0.07 | 17.0 | 26.0 |
| 3 | 3 | 71.0 | 86.0 | 98.0 | 29.0 | 14.0 | 2.0 | 0.14 | 15.0 | 12.0 |
| 4 | 4 | 62.0 | 87.0 | 99.0 | 38.0 | 13.0 | 1.0 | 0.08 | 25.0 | 12.0 |
| 5 | 5 | 55.0 | 88.0 | 99.3 | 45.0 | 12.0 | 0.7 | 0.06 | 33.0 | 11.3 |
| 6 | 6 | 54.0 | 88.0 | 99.3 | 46.0 | 12.0 | 0.7 | 0.06 | 34.0 | 11.3 |
| 7 | 7 | 54.0 | 87.0 | 99.2 | 46.0 | 13.0 | 0.8 | 0.06 | 33.0 | 12.2 |
| 8 | 8 | 53.0 | 86.0 | 99.1 | 47.0 | 14.0 | 0.9 | 0.06 | 33.0 | 13.1 |
| Comparative Example: | | | | | | | | | | |
| 1 | 9 | 42.0 | 90.0 | 99.6 | 58.0 | 10.0 | 0.4 | 0.04 | 48.0 | 9.6 |
| 2 | 10 | 65.0 | 84.0 | 95.0 | 35.0 | 16.0 | 5.0 | 0.31 | 19.0 | 11.0 |
| 3 | 11 | 57.0 | 99.0 | 99.8 | 43.0 | 1.0 | 0.2 | 0.20 | 42.0 | 0.8 |
| 4 | 12 | 32.0 | 64.0 | 72.0 | 68.0 | 36.0 | 28.0 | 0.78 | 32.0 | 8.0 |
| 5 | 13 | 40.0 | 98.0 | 99.0 | 60.0 | 2.0 | 1.0 | 0.50 | 58.0 | 1.0 |
| 6 | 14 | 84.0 | 95.0 | 100.0 | 16.0 | 5.0 | 0.0 | 0.00 | 11.0 | 5.0 |
| 7 | 15 | 100.0 | 100.0 | 100.0 | 0.0 | 0.0 | 0.0 | — | 0.0 | 0.0 |
| 8 | 16 | 88.0 | 89.0 | 90.0 | 12.0 | 11.0 | 10.0 | 0.91 | 1.0 | 1.0 |
| 9 | 17 | 93.0 | 97.0 | 97.0 | 7.0 | 3.0 | 3.0 | 1.00 | 4.0 | 0.0 |

TABLE 4

| | | Toner Evaluation Results | | | | | | |
|---|---|---|---|---|---|---|---|---|
| | | | | | Image density | | | |
| | | | High-temp. anti-offset properties | | Image reprod. test (high temp./humid.) | | Severe leaving test at 40° C., 90% RH | |
| | Toner No. | Fixing start temp. (° C.) | Fine-line area (° C.) | Solid-black area (° C.) | Initial stage | Running finish stage | Initial stage | 500th sheet |
| Example: | | | | | | | | |
| 1 | 1 | 140 | 250 | 250 | 1.50 | 1.50 | 1.50 | 1.50 |
| 2 | 2 | 145 | 250 | 250 | 1.44 | 1.43 | 1.44 | 1.43 |
| 3 | 3 | 140 | 240 | 240 | 1.47 | 1.45 | 1.45 | 1.42 |
| 4 | 4 | 145 | 240 | 230 | 1.44 | 1.43 | 1.40 | 1.39 |
| 5 | 5 | 145 | 240 | 230 | 1.43 | 1.41 | 1.38 | 1.36 |
| 6 | 6 | 150 | 240 | 230 | 1.42 | 1.42 | 1.38 | 1.36 |
| 7 | 7 | 150 | 240 | 230 | 1.41 | 1.41 | 1.37 | 1.36 |
| 8 | 8 | 155 | 240 | 230 | 1.40 | 1.39 | 1.37 | 1.36 |
| Comparative Example: | | | | | | | | |
| 1 | 9 | 155 | 245 | 220 | 1.40 | 1.38 | 1.36 | 1.30 |
| 2 | 10 | 150 | 245 | 235 | 1.35 | 1.30 | 1.35 | 1.33 |
| 3 | 11 | 150 | 240 | 210 | 1.33 | 1.32 | 1.38 | 1.34 |
| 4 | 12 | 180 | 235 | 230 | 1.32 | 1.30 | 1.30 | 1.30 |
| 5 | 13 | 190 | 235 | 210 | 1.35 | 1.35 | 1.30 | 1.30 |
| 6 | 14 | 150 | 210 | 200 | 1.30 | 1.25 | 1.21 | 1.10 |
| 7 | 15 | 150 | 180 | 170 | 1.18 | 1.05 | 1.08 | 0.98 |
| 8 | 16 | 180 | 200 | 200 | 1.10 | 1.04 | 1.09 | 1.05 |
| 9 | 17 | 150 | 190 | 170 | 1.20 | 1.10 | 1.18 | 1.15 |

What is claimed is:

1. A toner which comprises at least a polyester resin as a binder resin component, and a colorant, wherein;

said toner contains:

(a) in the binder resin component, from 20.0% by weight to 65.0% by weight of a tetrahydrofuran-insoluble matter A1 in 6-hour extraction and from 35.0% by weight to 80.0% by weight of a tetrahydrofuran-soluble matter A2 in 6-hour extraction;

(b) in the binder resin component, from 10.0% by weight to 30.0% by weight of a tetrahydrofuran-insoluble matter B1 in 16-hour extraction and from 70.0% by weight to 90.0% by weight of a tetrahydrofuran-soluble matter B2 in 16-hour extraction; and (c) in the binder resin component, from 0.5% by weight to 3.0% by weight of an orthodichlorobenzene-insoluble matter C1 in 6-hour extraction at 185° C. and from 97.0% by weight to 99.5% by weight of an orthodichlorobenzene-soluble matter C2 in 6-hour extraction at 185° C.;

(d) the proportion of C1 to B1, C1/B1, being from 0.06 to 0.15, and the A1, B1 and C1 satisfying the following expression (1):

$$A1>B1>C1. \qquad \text{Expression (1)}$$

2. The toner according to claim 1, wherein said tetrahydrofuran-insoluble matter A1 in 6-hour extraction and said tetrahydrofuran-insoluble matter B1 in 16-hour extraction are in a difference (insoluble-matter quantity A1-insoluble-matter quantity B1) of from 10.0% by weight to 55.0% by weight.

3. The toner according to claim 1, wherein said tetrahydrofuran-insoluble matter B1 in 16-hour extraction and said orthodichlorobenzene-insoluble matter C1 in 6-hour extraction at 185° C. are in a difference (insoluble-matter quantity B1-insoluble-matter quantity C1) of from 10.0% by weight to 29.5% by weight.

4. The toner according to any one of claims 1 to 3, wherein the polyester resin used as said binder resin component is a condensation polymerization product of at least (i) a tetrahydric or higher hydroxyl compound or tetrabasic or higher carboxylic acid and (ii) a trihydric or lower hydroxyl compound or tribasic or lower carboxylic acid.

5. The toner according to claim 1, wherein said polyester resin component has, in a chromatogram in measurement by gel permeation chromatography of the tetrahydrofuran-soluble matter of the toner, a main peak in the region of molecular weight of from 3,000 to 10,000.

6. The toner according to claim 1, which further comprises a wax; the wax having a ratio of weight-average molecular weight Mw to number-average molecular weight Mn which are measured by gel permeation chromatography, Mw/Mn, of from 1.0 to 2.0; and the toner has, in its differential thermal analysis, at least one endothermic peak at from 60° C. to 120° C.

* * * * *